United States Patent [19]

Jöerg

[11] 4,186,711

[45] Feb. 5, 1980

[54] IGNITION DEVICE WITH SPEED LIMITATION FOR INTERNAL COMBUSTION ENGINES

[75] Inventor: Manfred Jöerg, Fuerth, Fed. Rep. of Germany

[73] Assignee: Helga Mueller, Fed. Rep. of Germany

[21] Appl. No.: 806,216

[22] Filed: Jun. 13, 1977

[30] Foreign Application Priority Data

Jul. 6, 1976 [DE] Fed. Rep. of Germany ..... 2630261

[51] Int. Cl.[2] ..... F02P 1/00

[52] U.S. Cl. ..... 123/148 CC; 123/118

[58] Field of Search ..... 123/149 C, 148 CC, 118

[56] References Cited

U.S. PATENT DOCUMENTS

| | | | |
|---|---|---|---|
| 3,601,103 | 8/1971 | Swiden | 123/118 |
| 3,651,793 | 3/1972 | Roth | 123/118 |
| 3,967,604 | 7/1976 | Kondo | 123/118 |
| 3,985,109 | 10/1976 | Kondo | 123/118 |
| 3,993,031 | 11/1976 | Schmaldienst | 123/118 |
| 4,010,726 | 3/1977 | Kondo | 123/118 |
| 4,058,106 | 11/1977 | Drews | 123/118 |

*Primary Examiner*—Ronald B. Cox
*Attorney, Agent, or Firm*—Frank J. Jordan

[57] ABSTRACT

An ignition arrangement with speed limitation for internal combustion engines in which a trigger pulse actuates a switch for generating a high ignition voltage, particularly a capacitor ignition device with thyristor control. A timing circuit is triggered by a pulse for preventing renewed actuation of the switch by a trigger pulse within a predetermined reference time interval of the timing circuit. The timing circuit, furthermore, short-circuits the control part of the switch. Each trigger pulse actuates the timing circuit only after the switch for generating the high voltage. A transistor is connected in parallel with the control path of the switch, and the transistor's control electrode is connected to the output of the timing circuit switched by the trigger pulse. An electronic discharge switch actuated by the trigger pulse, is connected in parallel to a time-determining capacitor of the timing circuit. Upon reaching a predetermined voltage across the capacitor, the latter resets the timing circuit.

9 Claims, 3 Drawing Figures

$$t_K = \frac{60 \text{ sec.}}{\text{LIMIT} = \text{min}}$$

IGNITION DEVICE WITH SPEED LIMITATION FOR INTERNAL COMBUSTION ENGINES

BACKGROUND OF THE INVENTION

The present invention relates to an ignition device with speed limitation for internal combustion engines in which a trigger pulse actuates a switching or contact mechanism used for generating the ignition high voltage, particularly a capacitor ignition device with thyristor control.

The known speed limiter devices have in common that the voltage induced by a rotating magnet system in a coil, and depending on the rpm of the magnet system, serves as a speed criterion. A significant disadvantage of the method is that the voltage depends not only on the rpm of the magnet system, but also on the air gap width between the rotating magnet system and the fixed core, and on the field strength of the field spider magnet. This makes it nearly impossible for the manufacturer of such ignition systems to predetermine a definite speed limit for the ignition system without expensive individual tests and adjustments of each individual ignition system.

Accordingly, it is an object of the present invention to avoid these difficulties and to provide an ignition device with speed limitation for internal combustion engines where a simple determination by the manufacturer of the speed limits is possible within narrow tolerances.

Another object of the present invention is to provide an ignition device of the foregoing character which is substantially simple in construction and may be economically fabricated.

A further object of the present invention is to provide an ignition device, as described, which may be readily maintained in service and which has a substantially longer operating life.

SUMMARY OF THE INVENTION

The objects of the present invention are achieved by providing an ignition device of the foregoing species which has a timer unit triggered by a pulse that prevents renewed actuation of the switching or contact mechanism by a trigger pulse within a predetermined referenced time.

For this purpose, the timer unit short-circuits the control section of the switching or contact mechanism used for high-voltage generation, for example, the control thyristor of a condenser ignition device, thus preventing actuation by possible renewed trigger pulses during the reference period.

The important advantage of the ignition device with speed limitation in accordance with the present invention is as follows: Besides the circuit for generating a nominal reference signal, which can be manufactured without difficulties within narrow tolerances, an additional tachometer, etc. whose use involves a series of shortcomings, can be completely dispensed with. Instead, by means of a timer unit, a reference time is produced which is pecisely equal to one period of revolution of the internal combustion engine at the associate limiting rpm. With the circuit in accordance with the present invention, the reference time is generated by each voltage pulse in the trigger coil and blocks the control electrode of the switching mechanism which generates the high voltage during the reference time.

To avoid the hazard that the timer unit disturbs the operation of the ignition device in the normal operating range, i.e. below the given limiting speed of the internal combustion engine, the circuit should be arranged so that each trigger pulse actuates the timer unit only after the switching mechanism which generates the high voltage. This condition can be met by suitably dimensioning the components ensuring that triggering by the trigger voltage, increasing over a time interval, takes place earlier, i.e. at a lower voltage than the triggering of the blocking circuit with the timer unit.

In further improving the present invention, an electronic switch, particularly a transistor, is connected in parallel with the control path of the switching mechanism; the control electrode of this switch is connected to the output of timing circuit triggered by the trigger pulse. In this manner, the transistor is connected through during the on-period of the timing circuit so that possible trigger pulses during this period cannot lead to an actuation of the switching mechanism and hence not to the generation of a high-voltage pulse.

The speed limitation is achieved circuit-wise as follows: an electronic discharge switch, actuated by the trigger pulse, is connected in parallel to the time-determining capacitor of the timing circuit; upon reaching a given charge voltage, this capacitor brings about its reset.

As a result, upon reaching the given speed limit where the time interval between two successive trigger pulses is smaller than the reference time of the timer unit, a discharge of the timing capacitor takes place already before the end of the reference time during which an automatic discharge of the capacitor takes place, as is usual with sweep circuits. Hence the capacitor cannot reach its threshold voltage and can no longer disconnect the timer unit. The positive signal at the output of the timer unit remains and the electronic switch which bridges the control section of the switching mechanism remains continually switched through. The trigger pulse can no longer actuate the switching mechanism and lead to the generation of an ignition spark so that the speed (rpm) necessarily must become smaller till the periods between successive trigger pulses are no longer smaller than the switch-on time (reference time) of the timing circuit.

In series with the electronic discharge switch for the timing capacitor, with the switch actuated by the trigger pulses, there is provided a diode which, in connection with another diode in the trigger circuit, uncouples the latter from the time-determining circuit elements; in this case, the self-resetting circuit of the timing circuit is to contain a diode for circuit symmetry to discharge the time capacitor. This ensures that the unstable state of the timing circuit is always of equal duration, regardless whether the discharge of the time capacitor takes place over the internal discharge circuit of the timer circuit or over the external discharge circuit of the timer circuit which is controlled by the trigger pulses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
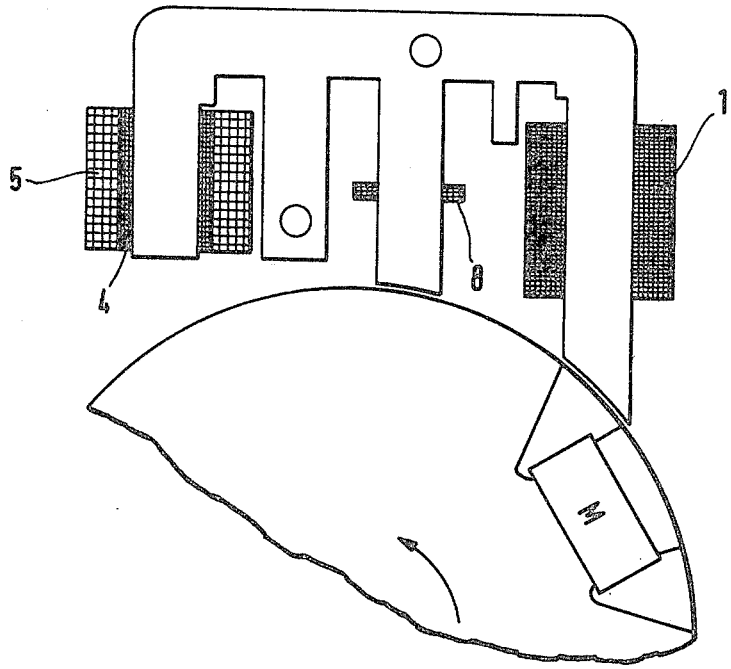
FIG. 1 shows a schematic of a capacitor ignition device in accordance with the present invention.
Figure 3:
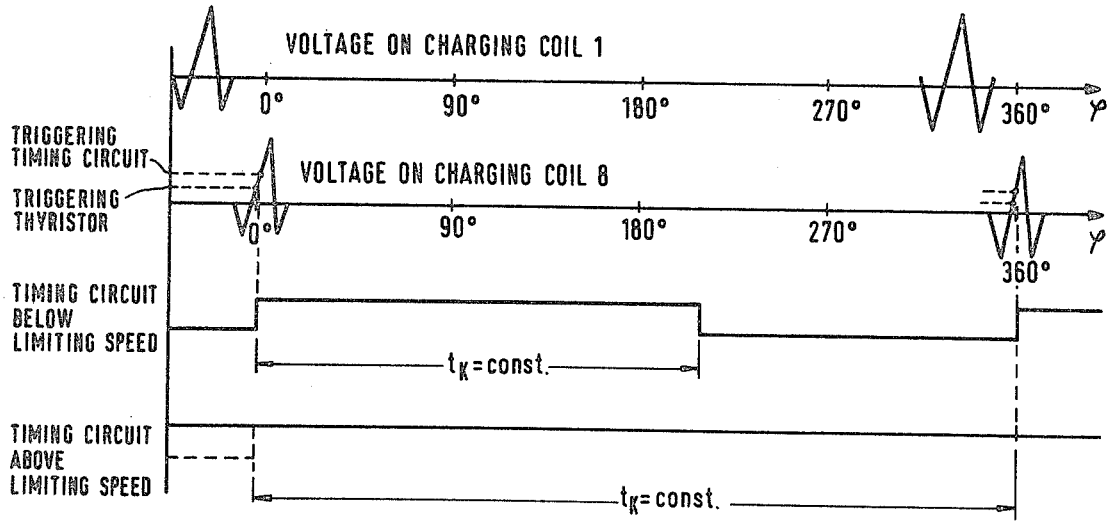
FIG. 3 shows a schematic voltage diagram showing the important signal of the ignition device in accordance with the present invention.

Referring to the drawings, the rotating magnet system M (FIG. 1) generates in the loading coil 1 of the ignition system, an alternating voltage which is rectified by the diode 2 and charges capacitor 3. The charge remains stored in this capacitor 3 until, an induced voltage (cf. FIG. 3) produced by running the magnet system past the trigger coil 8, hereinafter called trigger voltage, causes a current to flow through resistor 9 which causes the thyristor 6 to switch to the conducting state. The energy stored in capacitor 3 is discharged via the primary circuit 4 of the ignition repeater ZU. The high voltage induced in the secondary winding 5 of the ignition repeater ZU leads to sparkover at the electrodes of the sparkplug ZK. The diode 7 connected antiparallel to the thyristor ensures complete discharge of the capacitor 3 which otherwise would be prevented by resonance decay processes in the ignition repeater in connection with the rectifier action of the thyristor.

Figure 2:
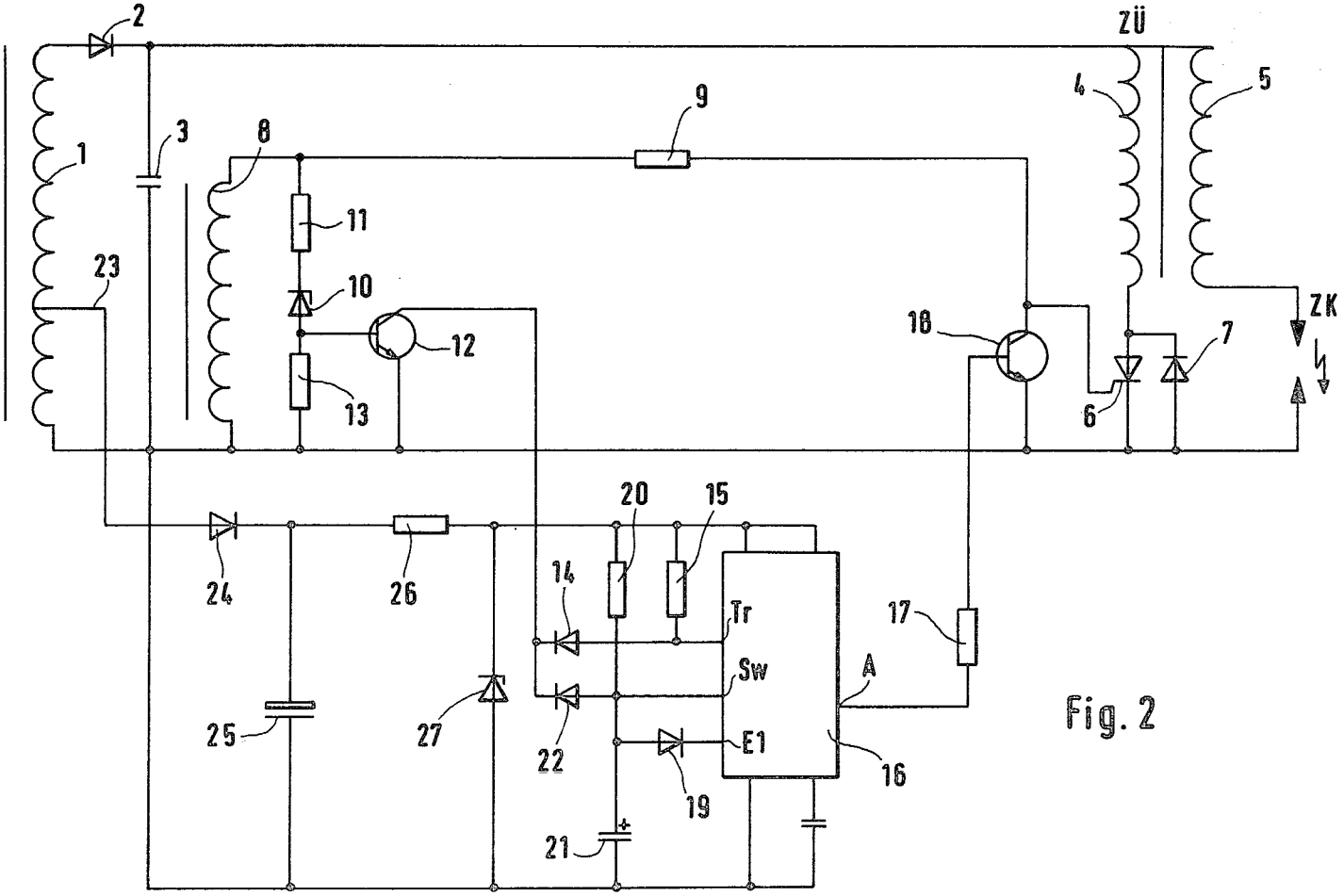
FIG. 2 shows the circuit arrangement of an ignition device with speed limitation in accordance with the present invention.

The tirgger pulse generated in the trigger coil 8, above a certain threshold voltage determined by the Zener diode 10, drives a current through the resistor 11 and the Zener diode 10 into the base of transistor 12—13 denotes a base bias resistor—and thus makes transistor 12 conducting. The current flowing through the diode 14 and resistor 15 causes a negative voltage jump at the trigger input Tr of the timing circuit 16. The timing circuit is shown as a box in the schematic since it involves a commercial circuit element (monostable or one-shot) preferably an integrated circuit. The external circuitry, which alone is involved in this invention, of timing circuit 16 is shown in detail in FIG. 2.

Due to the trigger signal, the voltage at output A of sweep circuit 16 jumps from zero to a positive value which is applied via resistor 17 to the base of transistor 18 and makes the latter conducting. In this conducting state, the transistor 18 bridges the control path of thyristor 6 so that during the switching of transistor 18 to the conducting state, a possible trigger signal from the trigger coil 8 cannot produce switching through of thyristor 6 and hence no high-voltage ignition pulses.

With the switching on, described above, of the timing circuit 16, the discharge output E1 is released so that the charge current, previously flowing through diode 19 from the resistor 20, now charges the time capacitor 21 which, together with resistor 20, forms the actual time-determining network of the sweep circuit. The charge condition of capacitor 21 is monitored via the input Sw of the timing circuit 16 and, when a given threshold voltage is exceeded, causes a return of the voltage at output A to the zero value. At the same time, with the reset of the timing circuit to the initial condition, the discharge output E1 is switched back to zero volts, i.e., to chassis potential, so that with the reset of the timing circuit there automatically takes place a discharge of the capacitor 21 via diode 19 and the internal discharge circuit of timing circuit 16. Transistor 18 is blocked again. A trigger pulse generated by trigger coil 8 again may reach the control electrode of thyristor 6 and fire the latter, producing a renewed high voltage spark-over on spark plug ZK.

The time from the release of the discharge output E1 till the threshold voltage Sw is reached, corresponds to the reference time which is constant throughout the entire speed range. With increasing speed, the interval between successive trigger pulses from the trigger coil 8 steadily approaches the given reference time and finally becomes even smaller when the limiting speed is exceeded, i.e., a new trigger pulse is produced even before the reference time has passed. In this case, the time capacitor 21 is discharged via transistor 12, which has been made conducting through the trigger pulse, and diode 22 before the threshold voltage is reached, so that the timing circuit 16 can no longer switch back from the unstable state, with positive output voltage at output A, to the stable state with output voltage zero. As a result, the transistor 18 remains continually in the coducting state and the trigger current via the resistor 9 cannot get to the control electrode of thyristor 6. In this operating state, ignition is no longer possible. As a result, the speed of the internal combustion engine decreases till it has dropped again to a value below the speed limit so that resetting of the sweep circuit 16 to the stable initial state is possible and the trigger signals are no longer short-circuited by transistor 18 so as to bypass thyristor 6.

To supply voltage to the limiter electronic system, part of the AC voltage induced in the charging coil 1 is taken off via pickoff 23, is rectified through the diode 24 and stored in capacitor 25, and stabilized via resistor 26 and the Zener diode 27.

The diode 19 is mainly used to make the circuit symmetrical to ensure that the unstable switch-on state of the timing circuit (reference time) always lasts the same time, regardless of whether the discharge of the threshold value capacitor 21 proceeds over the external discharge circuit via transistor 12 and diode 22, or over the internal discharge circuit E1 and diode 19.

The invention is not restricted to the embodiment shown. Particularly, besides a large number of circuit modifications of the ignition device with speed limitation, it is also possible to use the principle of speed limitation by blocking the switching mechanism serving for high-voltage generation via a reference timer unit triggered by the trigger pulses, also in other ignition devices besides the capacitor ignition device with transistor control provided in the specific embodiment.

Without further analysis, the foregoing will so fully reveal the gist of the present invention that others can, by applying current knowledge, readily adapt it for various applications without omitting features that, from the standpoint of prior art, farily constitute essential characteristics of the generic or specific aspects of this invention, and therefore, such adaptations should and are intended to be comprehended within the meaning and range of equivalence of the following claims.

What is claimed is:

1. An ignition arrangement with speed limitation for internal combustion engines comprising: a voltage source; switching means actuatable by a trigger pulse for generating a high ignition voltage and including capacitor ignition means with thyristor control; timing means triggered by a trigger pulse for preventing renewed actuation of said switching means by a trigger pulse within a predetermined reference time interval of said timing means, a magnet moving past an ignition armature for inducing said high ignition voltage; said switching means generating a substantially precisely predetermined and temperature-compensated pulse with each trigger pulse, said temperature-compensated pulse being independent of the potential of said voltage source and having said predetermined reference time interval at limiting rotational speed when below the limiting rotational speed; discharge switch means being actuatable by said trigger pulse; said timing means having a time-determining capacitor connected in parallel with said discharge switch means, said capacitor resetting said timing means upon attaining a predetermined charge voltage.

2. An ignition arrangement with speed limitation for internal combustion engines comprising: a voltage source; switching means actuatable by a trigger pulse for generating a high ignition voltage and including capacitor ignition means with thyristor control; timing means triggered by a trigger pulse for preventing renewed actuation of said switching means by a trigger pulse within a predetermined reference time interval of said timing means; a magnet moving past an ignition armature for inducing said high ignition voltage; said switching means generating a substantially precisely predetermined and temperature-compensated pulse with each trigger pulse, said temperature-compensated pulse being independent of the potential of said voltage source and having said predetermined reference time interval at limiting rotational speed when below the limiting rotational speed; said switching means having a control path short-circuited by said timing means, each trigger pulse actuating said timing means only after actuation of said switching means for generating said high voltage; a transistor; said switching means having a control path connected in parallel with said transistor; said transistor having a control electrode connected to the output of said timing means triggered by said trigger pulse; discharge switch means actuatable by said trigger pulse; said timing means having a time-determining capacitor connected in parallel with said discharge switch means, said capacitor resetting said timing means upon attaining a predetermined charge voltage; a decoupling diode connected in series with said discharge switch means; said timing means having a self-resetting circuit; and diode means in said self-resetting circuit for switching symmetry and discharging said time-determining capacitor.

3. The ignition arrangement as defined in claim 1 wherein said switching means (6) has a control path short-circuited by said timing means.

4. The ignition arrangement as defined in claim 1 wherein each trigger pulse actuates said timing means only after actuation of said switching means (6) for generating said high voltage.

5. The ignition arrangement as defined in claim 1 including a transistor (18); said switching means (6) having a control path connected in parallel with said transistor; said transistor having a control electrode connected to the output of said timing means (16) triggered by said trigger pulse.

6. The ignition arrangement as defined in claim 1 including a decoupling diode (22) connected in series with said discharge switch means (12).

7. The ignition arrangement as defined in claim 6 wherein said timing means (16) has a self-resetting circuit (E1); and diode means (19) in said self-resetting circuit for switching symmetry and discharging said time-determining capacitor (21).

8. The ignition arrangement as defined in claim 1 wherein said ignition arrangement comprises a generator-ignition system.

9. The ignition arrangement as defined in claim 2 wherein said ignition arrangement comprises a generator-ignition system.

* * * * *